US005546867A

United States Patent [19]

Lipsius et al.

[11] Patent Number: 5,546,867

[45] Date of Patent: Aug. 20, 1996

[54] TRUCK FRAME FOR A RAILBORNE VEHICLE

[75] Inventors: Johann M. Lipsius; Wolfgang Auer, both of Kassel, Germany

[73] Assignee: ABB Patent GmbH, Mannheim, Germany

[21] Appl. No.: 511,045

[22] Filed: Aug. 3, 1995

Related U.S. Application Data

[63] Continuation of Ser. No. 203,283, Feb. 28, 1994, abandoned.

[30] Foreign Application Priority Data

Feb. 27, 1993 [DE] Germany ..... 43 06 112.5

[51] Int. Cl.[6] ..... B61F 5/38

[52] U.S. Cl. ..... 105/168

[58] Field of Search ..... 105/167, 168, 105/218.2; 280/81.6

[56] References Cited

U.S. PATENT DOCUMENTS

| | | | |
|---|---|---|---|
| 4,170,179 | 10/1979 | Vogel | 105/168 |
| 4,648,326 | 3/1987 | Jackson | 105/168 |
| 4,676,172 | 6/1987 | Bullock | 105/168 |
| 4,903,613 | 2/1990 | Lang et al. | 105/167 |
| 5,211,116 | 5/1993 | Schneider | 105/168 |
| 5,263,420 | 11/1993 | Schwendt et al. | 105/168 X |

FOREIGN PATENT DOCUMENTS

| | | |
|---|---|---|
| 0303007 | 2/1989 | European Pat. Off. . |
| 0387744 | 9/1990 | European Pat. Off. . |
| 2419989 | 2/1980 | Germany . |
| 2553875 | 11/1983 | Germany . |
| 3725574 | 2/1989 | Germany . |

*Primary Examiner*—S. Joseph Morano

*Attorney, Agent, or Firm*—Herbert L. Lerner; Laurence A. Greenberg

[57] ABSTRACT

A railborne vehicle includes a truck frame having wrist blocks for articulatingly fastening wheelset guide rods. An intermediate partial frame is connected to the truck frame. The intermediate partial frame has bearings for fastening or bearing compensating levers.

6 Claims, 2 Drawing Sheets

TRUCK FRAME FOR A RAILBORNE VEHICLE

This application is a continuation of application Ser. No. 08/203,283, filed Feb. 28, 1994, now abandoned.

BACKGROUND OF THE INVENTION

Field of the Invention

The invention relates to a bogie or truck frame for a railborne vehicle, which may be used both with locomotives and non-driven railborne vehicles, and wherein the truck frame has wrist blocks for the articulated fastening of wheelset guide rods.

In an axle configuration being movable in the axial direction in the vehicle, bogie or truck frame of a railborne vehicle which is known from German Published, Prosecuted Application DE-AS 24 19 989, wheelset guide rods are provided between wheelset bearings/axle bearing housings and the bogie or truck frame. Unlike the above-mentioned configuration, in Published European Application No. 03 03 007 B1, the wheelset guide rods are disposed between wheelset bearing/axle bearing housings and compensating levers, so that at least two wheelset axles of one bogie or truck are coupled together for radial control through compensating levers.

It is a disadvantageous feature that one and the same bogie or truck frame cannot be used both to fasten the wheelset guide rods directly to the bogie or truck (which is also referred to below as rigid wheelset guidance) and to fasten the wheelset guide rods to compensating levers. The bogie or truck for the structure with compensating levers requires its own bearing for the pivot points of the compensating levers, while the bogie or truck for the structure with wheelset guide rods pivotably connected or articulated to the bogie or truck requires wrist blocks on the bogie or truck in order to fasten the wheelset guide rods.

SUMMARY OF THE INVENTION

It is accordingly an object of the invention to provide a truck frame for a railborne vehicle, which overcomes the hereinafore-mentioned disadvantages of the heretofore-known devices of this general type and which is universally suitable both for mounting wheelset guide rods being pivotably connected to the bogie or truck and for installing a radial control by means of compensating levers.

With the foregoing and other objects in view there is provided, in accordance with the invention, a railborne vehicle, comprising a truck frame having wrist blocks for articulatingly fastening wheelset guide rods; and an intermediate partial frame connected to the truck frame, the intermediate partial frame having bearings for fastening or bearing compensating levers.

The advantages attainable with the invention are in particular that only a single embodiment of a bogie or truck frame has to be manufactured and kept in inventory, which reduces production costs and makes stock-keeping of spare parts easier and less expensive. Conversion (retrofitting) from rigid wheelset guidance to radial control with compensating levers and vice versa are possible.

In accordance with another feature of the invention, the intermediate partial frame has bearings for a rigid pivot shaft joining the compensating levers of both sides of a truck.

In accordance with a concomitant feature of the invention, the intermediate partial frame is secured to the wrist blocks of the truck frame for the wheelset guide rods.

Other features which are considered as characteristic for the invention are set forth in the appended claims.

Although the invention is illustrated and described herein as embodied in a bogie or truck frame for a railborne vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
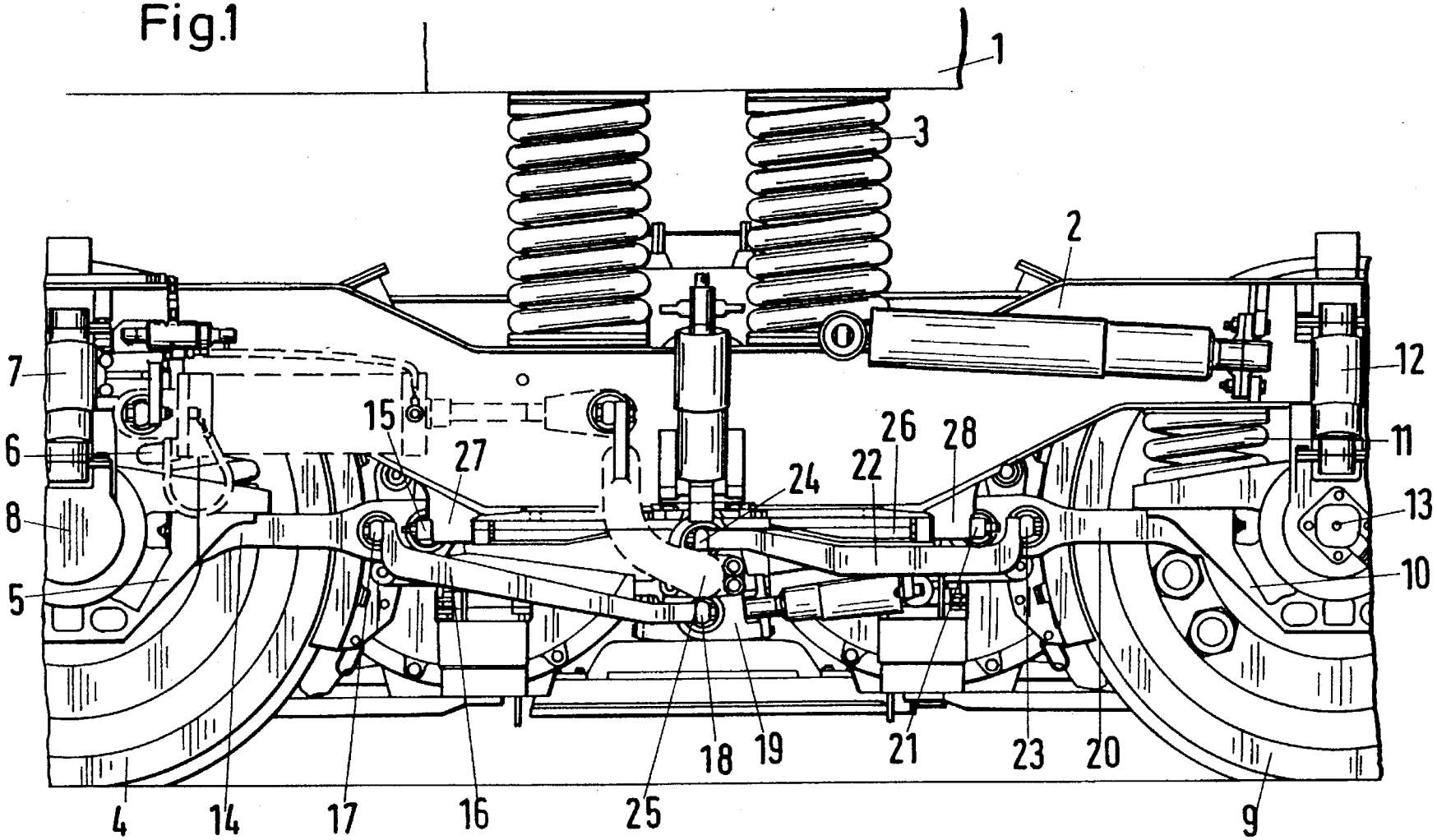
FIG. 1 is a fragmentary, diagrammatic, side-elevational view of a radially adjustable running gear for a railborne vehicle.

Referring now to the figures of the drawing in detail and first, particularly, to FIG. 1 thereof, there is seen a radially adjustable running gear or undercarriage for a railborne vehicle. A bogie or truck frame 2 is suspended from a car box 1 of a railborne vehicle. Spring elements 3 serve to provide suspension for the car box 1. Two wheel sets are suspended from the bogie or truck frame 2. A first wheel 4 of a first wheelset and a first wheel 9 of a second wheelset can be seen. An axle bearing housing 5 with a wheelset bearing of the first wheel 4 of the first wheelset is supported on the bogie or truck frame 2 through wheelset spring elements 6 and wheelset damping elements 7. A first wheelset axle is indicated by reference numeral 8.

An axle bearing housing 10 with a wheelset bearing of the first wheel 9 of the second wheelset is supported in the same manner on the bogie or truck frame 2 through wheelset spring elements 11 and wheelset damping elements 12. A second wheelset axle is identified by reference numeral 13.

A wheelset guide rod 14 is connected rigidly to the axle bearing housing 5 on one end and pivotably to the bogie or truck frame 2 on the other end through a wrist point 15. The wrist point 15 is displaceable horizontally but not vertically and represents a pivot point for deflections of the wheelset guide rod 14. A connecting guide rod 16 serves to couple the wheelset guide rod 14 to a compensating lever 19. To that end, the guide rod 16 is connected both to the wheelset guide rod 14 through an articulation point 17, and to the compensating lever 19 through an articulation point 18.

In the same way, a wheelset guide rod 20 is connected rigidly to the axle bearing housing 10 on one end and pivotably to the bogie or truck frame 2 on the other through a wrist point 21. The wrist point 21 is displaceable horizontally but not vertically and represents a pivot point for deflections of the wheelset guide rod 20. A connecting guide rod 22 serves to couple the wheelset guide rod 20 to the compensating lever 19. To that end, the guide rod 22 is connected both to the wheelset guide rod 20 through an articulation point 23, and to the compensating lever 19 through an articulation point 24.

A pivot point 25 of the compensating lever 19 is located centrally between the two articulation points 18, 24, and in the position of repose, in other words when the railborne vehicle is traveling straight ahead, these articulation points are oriented vertically.

As can be seen from the geometrical configuration of the connections between the wheelset guide rods 14, 20, the connecting guide rods 16, 22 and the compensating lever 19, the result when the railborne vehicle travels around curves is radial control that is symmetrical with respect to the two wheelsets. If the two wheels 4, 9 are running on the rail on the inside of the curve, then the compensating lever 19 executes a counterclockwise rotary motion about the pivot point 25, and as a result the distance between the two axle bearing housings 5, 10 decreases in comparison with the position of repose. If the two wheels 4, 9 are running on the rail on the outside of the curve, then the compensating lever 19 executes a clockwise rotary motion about the pivot point 25, and as a result the distance between the two axle bearing housings 5, 10 increases in comparison with the position of repose.

The horizontally displaceable wrist points 15, 21 are preferably connected to wrist blocks 27, 28 of the bogie or truck frame 2. These wrist blocks also serve to articulate the wheelset guide rods directly to the bogie or truck frame in the case of running gears without radial control by means of compensating levers (as in German Published, Prosecuted Application DE-AS 24 19 989, for example) and for fastening an intermediate partial or split frame 26, which serves in particular to fasten or secure and support the compensating levers 19. The intermediate partial or split frame 26 is preferably screwed to the bogie or truck frame 2.

Figure 2:
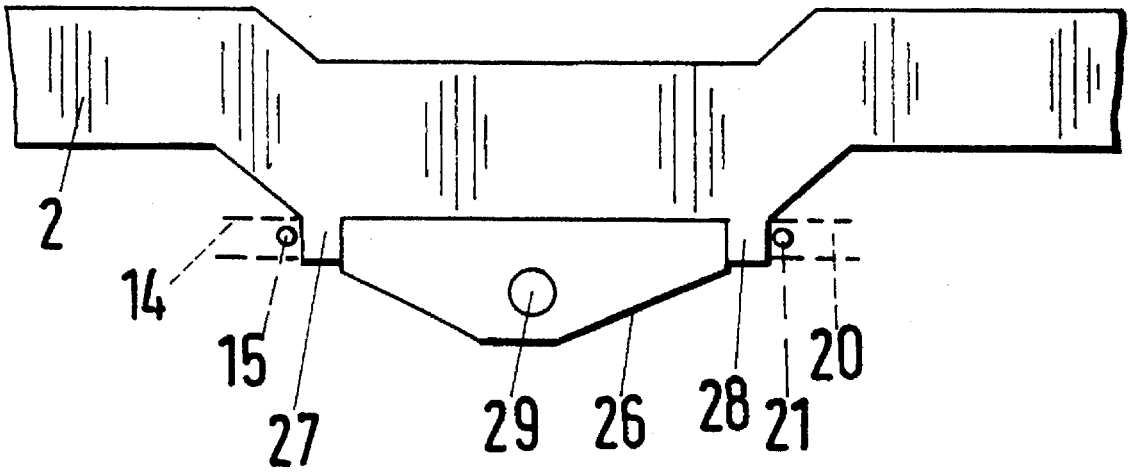
FIG. 2 is a fragmentary, side-elevational view showing a basic location of an intermediate partial or split frame.

FIG. 2 shows the basic location of the intermediate split or partial frame 26. Not only the bogie or truck frame 2 with the wrist blocks 27, 28 but also the intermediate partial or split frame 26 connected to the bogie or truck frame, can be seen. The intermediate partial or split frame 26 has bearings 29 for securing or bearing the compensating levers 19. The wrist blocks 27, 28 can at the same time serve to secure the wheelset guide rods 14, 20 through the wrist points 15, 21.

In addition to the tandem configuration of the wheelset bearing or connecting guide rod shown in FIG. 1, it is naturally also possible to connect the wheelset guide rods directly to the compensating levers (as in Published European Application No. 03 03 007 B1, for example). In that variant, the wrist blocks 27, 28 serve merely to secure the intermediate partial or split frame 26, and not to pivotably connect wheelset guide rods in a longitudinally displaceable manner.

If a rigid pivot shaft is used to connect the compensating levers of both sides of the bogie or truck, then the intermediate partial or split frame can advantageously be provided with pivot bearings, in order to absorb and transmit tensile forces arising on the sides of the bogie or truck.

We claim:

1. A bogie for a railborne vehicle with a rail car box, comprising:

a truck frame adapted to be suspended from a rail car box of a railborne vehicle, said truck frame having wrist blocks for articulatingly fastening wheelset guide rods;

wheelsets and axle bearing housings suspended from said truck frame, said wrist blocks being disposed between said axle bearing housings and said truck frame;

an intermediate partial frame having bearings for fastening and bearing compensating levers;

said intermediate partial frame having bearings for a rigid pivot shaft joining the compensating levers of both sides of a truck, and said intermediate partial frame being removably and directly secured to said wrist blocks of said bogie frame for the wheelset guide rods.

2. The bogie according to claim 1, further comprising fasteners, said intermediate partial frame being secured to said wrist blocks of said truck frame with said fasteners.

3. The bogie according to claim 2, wherein said fasteners are screws.

4. A railborne vehicle, comprising:

a truck with sides and truck frames;

wheelsets with wheels on said sides of said truck;

wheelset bearings and axle bearing housings for said wheels;

wheelset guide rods and compensating levers connecting said axle bearing housings to each other;

said truck frame having wrist blocks for articulatingly fastening said wheelset guide rods;

an intermediate partial frame having bearings and said compensating levers being fastened to said bearings; and said intermediate partial frame being removably and directly secured to said wrist blocks of said bogie frame for the wheelset guide rods.

5. The railborne vehicle according to claim 4, further comprising fasteners, said intermediate partial frame being secured to said wrist blocks of said truck frame with said fasteners.

6. The bogie according to claim 5, wherein said fasteners are screws.

* * * * *